US011214890B2

(12) United States Patent
Hanson

(10) Patent No.: US 11,214,890 B2
(45) Date of Patent: Jan. 4, 2022

(54) CLEANING COMPONENTS AND METHODS IN A PLATING SYSTEM

(71) Applicant: Applied Materials, Inc., Santa Clara, CA (US)

(72) Inventor: Kyle M. Hanson, Kalispell, MT (US)

(73) Assignee: Applied Materials, Inc., Santa Clara, CA (US)

( * ) Notice: Subject to any disclaimer, the term of this patent is extended or adjusted under 35 U.S.C. 154(b) by 191 days.

(21) Appl. No.: 16/265,503

(22) Filed: Feb. 1, 2019

(65) Prior Publication Data

US 2019/0233966 A1 Aug. 1, 2019

Related U.S. Application Data

(60) Provisional application No. 62/625,277, filed on Feb. 1, 2018.

(51) Int. Cl.
*C25D 21/08* (2006.01)
*C25D 17/00* (2006.01)
(Continued)

(52) U.S. Cl.
CPC ..... *C25D 21/08* (2013.01); *B08B 1/02* (2013.01); *B08B 3/022* (2013.01); *B08B 9/0936* (2013.01);
(Continued)

(58) Field of Classification Search
None
See application file for complete search history.

(56) References Cited

U.S. PATENT DOCUMENTS 6,186,873 B1 2/2001 Becker et al.
7,241,372 B2 * 7/2007 Sendai ..... C25D 17/00 134/21
(Continued)

FOREIGN PATENT DOCUMENTS

CN 101389415 A 3/2009
CN 104668218 A 6/2015
(Continued)

OTHER PUBLICATIONS

International Search Report and Written Opinion dated May 16, 2019 in International Patent Application No. PCT/US2019/015910, all pages.
(Continued)

*Primary Examiner* — Stefanie S Wittenberg
(74) *Attorney, Agent, or Firm* — Kilpatrick Townsend & Stockton LLP

(57) ABSTRACT

Systems for cleaning electroplating system components may include a seal cleaning assembly incorporated with an electroplating system. The seal cleaning assembly may include an arm pivotable between a first position and a second position. The arm may be rotatable about a central axis of the arm. The seal cleaning assembly may also include a cleaning head including a bracket portion coupled with a distal portion of the arm. The cleaning head may be characterized by a front portion formed to interface with a seal of the electroplating apparatus. The cleaning head may define a trench along the front portion, and the cleaning head may define a plurality of fluid channels through the cleaning head, each fluid channel of the plurality of fluid channels fluidly accessing a backside of the trench.

16 Claims, 6 Drawing Sheets

(51) Int. Cl.

| | |
|---|---|
| ***B08B 9/093*** | (2006.01) |
| ***C25D 17/06*** | (2006.01) |
| ***C25D 5/04*** | (2006.01) |
| ***B08B 1/02*** | (2006.01) |
| ***B08B 3/02*** | (2006.01) |
| *B08B 9/00* | (2006.01) |

(52) U.S. Cl.
CPC ..... *C25D 5/04* (2013.01); *C25D 17/004* (2013.01); *C25D 17/06* (2013.01); *B08B 9/00* (2013.01)

(56) References Cited

U.S. PATENT DOCUMENTS

| | | | | |
|---|---|---|---|---|
| 9,309,603 | B2 | 4/2016 | Woodruff | |
| 2013/0061875 | A1* | 3/2013 | Woodruff | C25D 17/001 134/6 |
| 2013/0256146 | A1 | 10/2013 | Chua et al. | |
| 2013/0292254 | A1* | 11/2013 | Kumar | C25D 17/001 205/81 |
| 2017/0056934 | A1 | 3/2017 | Wang et al. | |
| 2017/0299524 | A1* | 10/2017 | Arora | C25D 17/06 |

FOREIGN PATENT DOCUMENTS

| | | | | |
|---|---|---|---|---|
| JP | 2015062956 | * | 4/2015 | B24B 55/06 |
| TW | M535717 U | | 1/2017 | |
| WO | 2013-148890 A1 | | 10/2013 | |

OTHER PUBLICATIONS

International Preliminary Report on Patentability dated Aug. 4, 2020 in International Patent Application No. PCT/US2019/015910, 8 pages.

* cited by examiner

CLEANING COMPONENTS AND METHODS IN A PLATING SYSTEM

CROSS-REFERENCE TO RELATED APPLICATIONS

This application claims the benefit of U.S. Provisional Application No. 62/625,277, filed Feb. 1, 2018, and which is hereby incorporated by reference in its entirety for all purposes.

TECHNICAL FIELD

The present technology relates to cleaning operations in semiconductor processing. More specifically, the present technology relates to systems and methods that perform in situ cleaning for electroplating systems.

BACKGROUND

Integrated circuits are made possible by processes which produce intricately patterned material layers on substrate surfaces. After formation, etching, and other processing on a substrate, metal or other conductive materials are often deposited or formed to provide the electrical connections between components. Because this metallization may be performed after many manufacturing operations, problems caused during the metallization may create expensive waste substrates or wafers. One common problem is non-uniform formation of metal across a substrate surface.

Uniformity issues during metallization may be caused from a number of situations related to the process or the equipment. One example is plating on components of the chamber that are or become conductive, and which may cause local loss of metal on the substrate. Material may be plated on the contact ring, contact seal, or any other component that may be within the system. This errant formation may limit the amount of plating on the substrate, which can lead to insufficient plating, increased cost, and device failure.

Thus, there is a need for improved systems and methods that can be used to produce high quality devices and structures. These and other needs are addressed by the present technology.

SUMMARY

The present technology may include systems and methods for cleaning electroplating system components, which may include a seal cleaning assembly incorporated with an electroplating system. The seal cleaning assembly may include an arm pivotable between a first position and a second position. The arm may be rotatable about a central axis of the arm. The seal cleaning assembly may also include a cleaning head including a bracket portion coupled with a distal portion of the arm. The cleaning head may be characterized by a front portion formed to interface with a seal of the electroplating apparatus. The cleaning head may define a trench along the front portion, and the cleaning head may define a plurality of fluid channels through the cleaning head, each fluid channel of the plurality of fluid channels fluidly accessing a backside of the trench.

In some embodiments the front portion of the cleaning head may be at least partially characterized by an arcuate profile configured to accommodate an annular seal. The cleaning head may also include a contact pin at least partially extending through the trench and configured to be in direct contact with the seal. The cleaning head may also include a clearance pin at least partially extending through the trench and configured to define a gap between the clearance pin and the seal when the contact pin is in direct contact with the seal. The plurality of fluid channels of the cleaning head may include a first channel fluidly accessing a first position along the trench, and may include a second channel fluidly accessing a second position along the trench radially offset from the first position in a direction of rotation of the seal. The clearance pin may be positioned between the first position and the second position. In some embodiments the cleaning head may be or include a hydrophobic material.

Embodiments of the present technology additionally encompass electroplating systems that may include a system head having a rotor. The system head may be configured to hold a substrate for processing. The systems may include a seal positioned on the rotor. The systems may include a head lifter coupled with the system head and configured to position the system head. The systems may also include a seal cleaning assembly. The seal cleaning assembly may include an arm pivotable between a first position and a second position where a distal portion of the arm may be vertically aligned with an interior region of the system head. The arm may be rotatable about a central axis of the arm. The seal cleaning assembly may also include a cleaning head including a bracket portion coupled with a distal portion of the arm. The cleaning head may be characterized by a front portion formed to interface with an interior surface of the seal. The cleaning head may define a trench along the front portion, and the cleaning head may define a plurality of fluid channels through the cleaning head. Each fluid channel of the plurality of fluid channels may fluidly access a backside of the trench.

In some embodiments, the arm may be located in the second position, and the distal portion of the arm may be configured to rotate the cleaning head from a retracted position into direct contact with the seal. The system may include a torque-controlled motor configured to drive the arm and maintain contact between the cleaning head and the seal while the rotor rotates the seal across the cleaning head. The seal may be characterized by an annular form, and the front portion of the cleaning head may be at least partially characterized by an arcuate profile configured to accommodate an inner annular sidewall of the seal. The cleaning head may also include a contact pin at least partially extending through the trench and configured to be in direct contact with the seal during a cleaning operation. The cleaning head may also include a clearance pin at least partially extending through the trench and configured to define a gap between the clearance pin and the seal when the contact pin is in direct contact with the seal. The plurality of fluid channels may include a first channel fluidly accessing a first position along the trench and a second channel fluidly accessing a second position along the trench radially offset from the first position in a direction of rotation of the seal. The clearance pin may be positioned between the first position and the second position. The system may include a fluid delivery tube extending along the arm and configured to provide a fluid to the first channel. The system may also include a fluid removal tube extending along the arm and configured to remove the fluid from the second channel. In some embodiments a vacuum may be maintained through the fluid removal tube during operation.

Embodiments of the present technology may also encompass methods of cleaning an electroplating system contact seal. The methods may include delivering an acidic solution in a first fluid channel of a cleaning head. The cleaning head may be positioned to physically contact the electroplating system contact seal. The methods may include rotating the electroplating system contact seal across the cleaning head. The methods may also include extracting the acidic solution from the cleaning head through a second fluid channel radially offset from the first fluid channel in a direction of rotation of the electroplating system contact seal. In some embodiments the acidic solution may be substantially maintained within a volume defined in part by an inner surface of the electroplating system contact seal, a trench formed within a front portion of the cleaning head, and a contact pin at least partially extending through the trench proximate a leading edge of the cleaning head in a direction of rotation of the electroplating system contact seal.

Such technology may provide numerous benefits over conventional technology. For example, the present technology may reduce cleaning times by allowing in situ cleaning of a contact seal to be performed. Additionally, the apparatus used may facilitate an improved cleaning of the contact seal without compromising other system components with the cleaning solution. These and other embodiments, along with many of their advantages and features, are described in more detail in conjunction with the below description and attached figures.

BRIEF DESCRIPTION OF THE DRAWINGS

A further understanding of the nature and advantages of the disclosed embodiments may be realized by reference to the remaining portions of the specification and the drawings.

Figure 1:
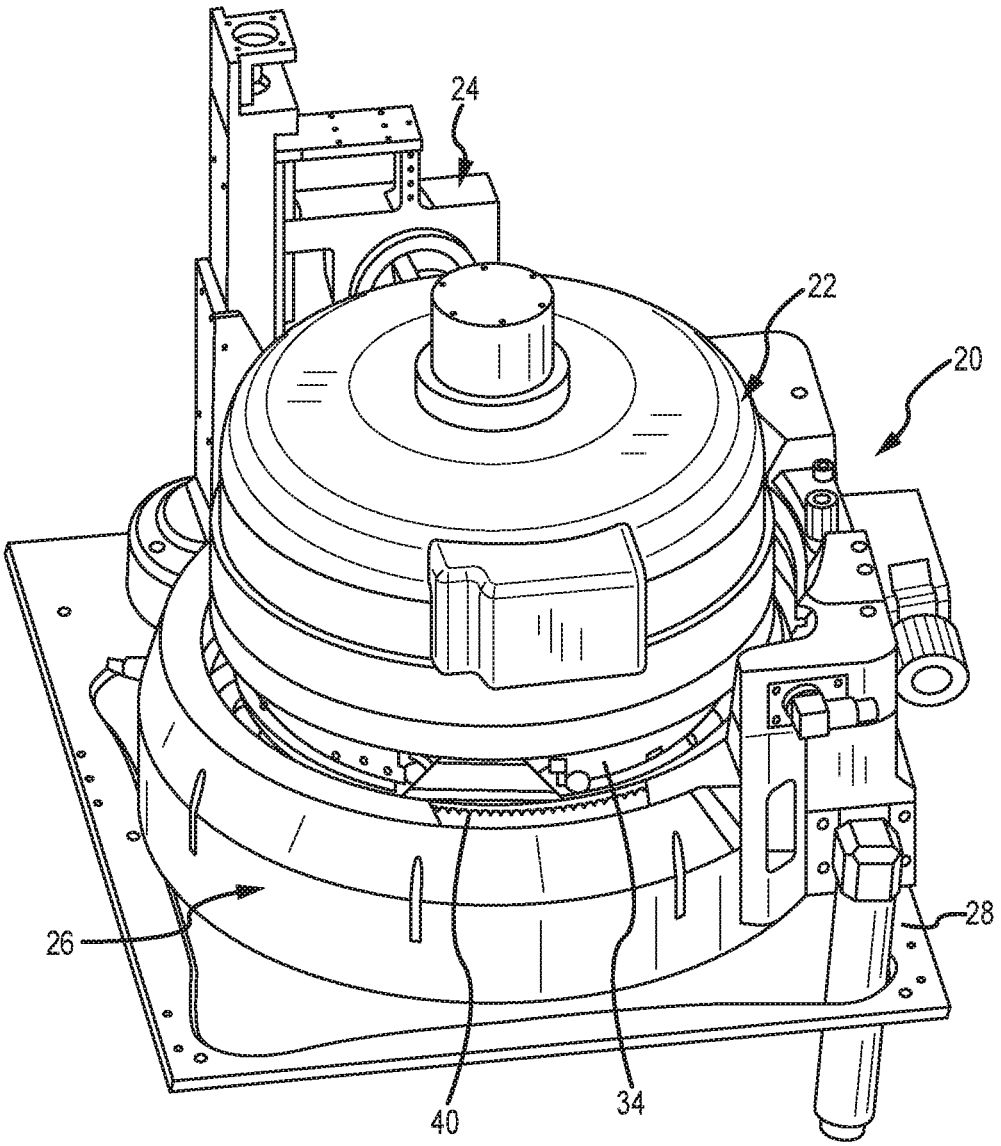
FIG. 1 shows a schematic perspective view of a chamber on which cleaning technology may be performed according to some embodiments of the present technology.

Several of the figures are included as schematics. It is to be understood that the figures are for illustrative purposes, and are not to be considered of scale unless specifically stated to be of scale. Additionally, as schematics, the figures are provided to aid comprehension and may not include all aspects or information compared to realistic representations, and may include exaggerated material for illustrative purposes.

In the figures, similar components and/or features may have the same numerical reference label. Further, various components of the same type may be distinguished by following the reference label by a letter that distinguishes among the similar components and/or features. If only the first numerical reference label is used in the specification, the description is applicable to any one of the similar components and/or features having the same first numerical reference label irrespective of the letter suffix.

DETAILED DESCRIPTION

Various operations in semiconductor manufacturing and processing are performed to produce vast arrays of features across a substrate. As layers of semiconductors are formed, vias, trenches, and other pathways are produced within the structure. These features may then be filled with a conductive or metal material that allows electricity to conduct through the device from layer to layer. As device features continue to shrink in size, so too does the amount of metal providing conductive pathways through the substrate. As the amount of metal is reduced, the quality and uniformity of the fill may become more critical to ensure adequate electrical conductivity through the device. Accordingly, manufacturing may attempt to reduce or remove imperfections and discontinuities in the pathways.

Electroplating operations may be performed to provide conductive material into vias and other features on a substrate. Electroplating utilizes an electrolyte bath containing ions of the conductive material to electrochemically deposit the conductive material onto the substrate and into the features defined on the substrate. The substrate on which metal is being plated operates as the cathode. An electrical contact, such as a ring or pins, may allow the current to flow through the system. This contact may be protected from the electrolyte by a seal, which may prevent metal from being plated on other conductive components. The seal is often a non-conductive material, however, over time the seal may become conductive due to residues formed on the seal during plating operations. When sufficiently conductive, plating may occur on the seal, which may reduce local plating on the substrate, causing uniformity issues, which may result in scrapped substrates or wafers.

Conventional technologies often halt operations between wafers to clean residues from this seal. The system may be partially disassembled, and the seal may be cleaned and scrubbed manually before being replaced in the tool. This process is time consuming, and abrasive scrubbing may further roughen the seal surfaces increasing the amount of conductive residue that may remain on the seal during processing.

The present technology overcomes these issues by incorporating a cleaning system that may perform an in situ clean of the seal. The system may include a nozzle or head that may be extended against the seal, and a cleaning solution may be flowed against the seal to remove any residues. By utilizing cleaning systems according to the present technology, cleaning may be performed more easily, and surface damage to the seal may be limited or reduced. After describing an exemplary chamber for which embodiments of the present technology may be performed, the remaining disclosure will discuss aspects of the systems and processes of the present technology.

FIG. 1 shows a schematic perspective view of an electroplating system 20 for which methods and cleaning systems may be utilized and practiced according to embodiments of the present technology. Electroplating system 20 illustrates an exemplary electroplating system including a system head 22 and a bowl 26. During electroplating operations, a wafer may be clamped to the system head 22, inverted, and extended into bowl 26 to perform an electroplating operation. Electroplating system 20 may include a head lifter 24, which may be configured to both raise and rotate the head 22, or otherwise position the head within the system. The head and bowl may be attached to a deck plate 28 or other structure that may be part of a larger system incorporating multiple electroplating systems 20, and which may share electrolyte and other materials. Rotor 34 may allow a substrate clamped to the head to be rotated within the bowl, or outside the bowl in different operations. The rotor may include a contact ring 40, which may provide the conductive contact with the substrate. FIG. 1 illustrates an electroplating chamber that may include components to be cleaned directly on the platform. It is to be understood that other configurations are possible, including platforms on which the head is moved to an additional module and seal or other component cleaning is performed. Additionally, one or more components, such as a seal ring may be removed from a chamber and placed in a maintenance system or cleaning system for cleaning. Any number of other operations may be performed that provide or expose a component for cleaning.

Figure 2:
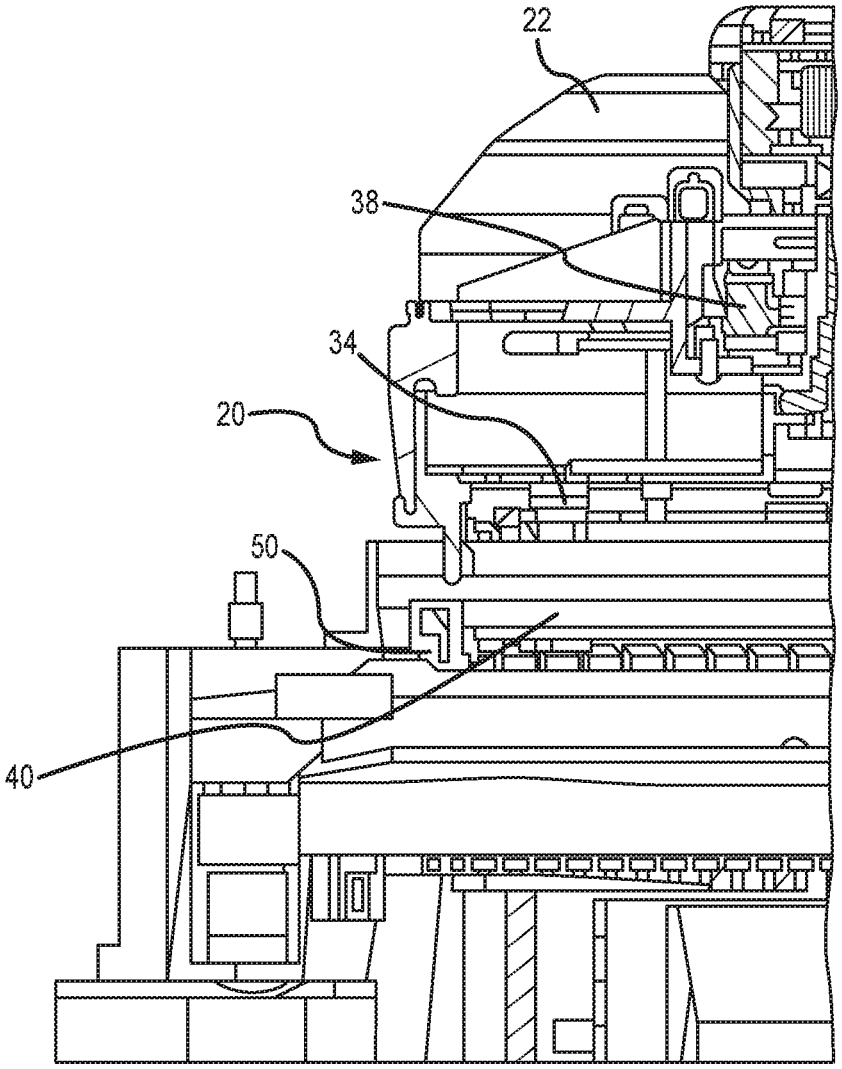
FIG. 2 shows a partial cross-sectional view of a chamber with which seal cleaning assemblies may be associated according to some embodiments of the present technology.

Turning to FIG. 2 is shown a partial cross-sectional view of electroplating system 20. A motor 38 included within the head may allow rotation of the contact ring 40, as well as a contact seal 50, which may seal against the substrate. This seal may allow isolation of the contact ring 40 from the electrolyte during operation, which may prevent plating on the contact ring. The seal may be made of an insulative material, and may be made of materials configured to limit interaction with the electrolyte. For example, the seal material may include a number of polymers including elastomers, and may include fluoropolymers, such as fluoroelastomers, including any FKM materials including Type 1, Type 2, Type 3, Type 4, and Type 5 FKM materials. The materials may also include perfluoroelastomers including any FFKM materials, as well as tetrafluoroethylene/propylene rubbers or FEPM. Seal materials may also include thermoplastic elastomers, including thermoplastic vulcanizates, and elastomers with additional moieties, such as styrene ethylene butylene styrene, as well as materials developed from polyolefins or other plastics. The seal may also include any other materials that may be compatible with electroplating systems and electrolytes.

Figure 3:
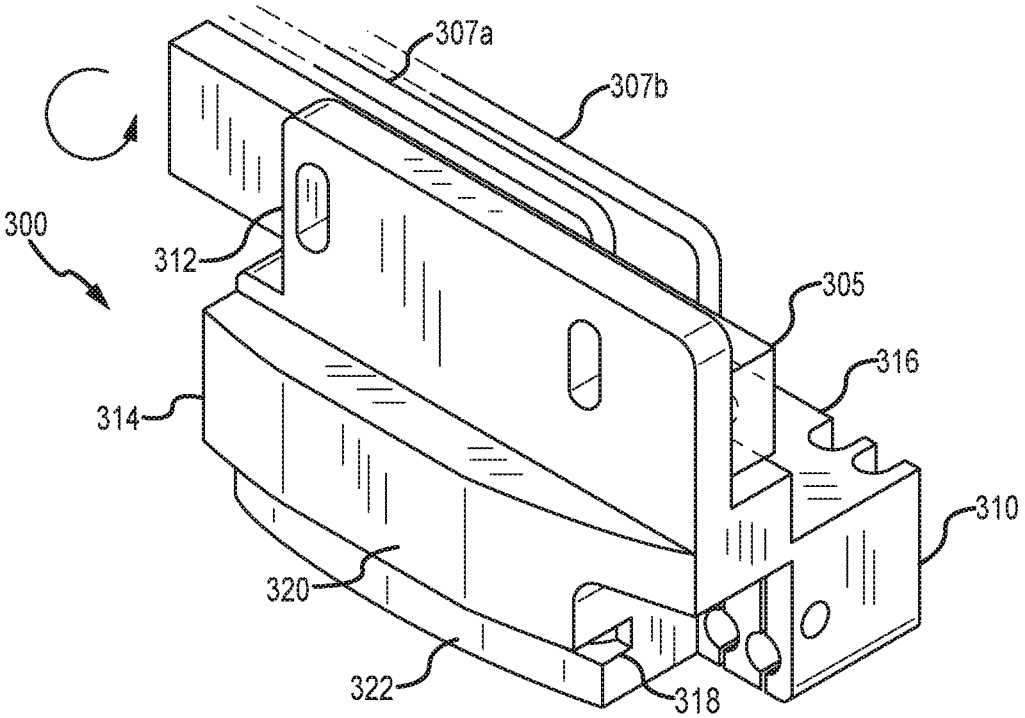
FIG. 3 shows a schematic perspective view of a cleaning head according to some embodiments of the present technology.

As previously explained, residues may form on the seal during electroplating operations. In some embodiments of the present technology, subsequent a plating operation, the substrate may be removed, and the seal may be cleaned. The seal may be cleaned on the same platform on which the bowl resides, or the head may be repositioned to a separate module either associated with or connected to system 20. Head 22 may be inverted, and a seal cleaning assembly may be used to clean the seal while the seal is still connected with the head. FIG. 3 illustrates a schematic front perspective view of seal cleaning assembly 300 as may be used in embodiments of the present technology. With the substrate removed, and the head 22 inverted, seal cleaning assembly 300 may be positioned within a cavity of the head, and used to clean the interior of the seal, which may have plating residues on the surface. It is to be understood that inversion of the head may not be critical, and the present systems may be operated to accommodate a seal in any orientation.

As illustrated, seal cleaning assembly 300 may include an arm 305, and a cleaning head 310. Arm 305 may be a swing arm or other device associated with the electroplating system or a maintenance system for the head, and may be pivotable between a number of positions including a first position, which may be retracted, and a second position, which may be an operational position and may position a distal portion of arm 305, with which cleaning head 310 may be coupled, at a location that may be vertically aligned with an interior region of the system head 22. Arm 305 may also be rotatable about a central axis of the arm, which may allow the cleaning head to be raised and lowered to an operational position in which the cleaning head may be in contact with a seal. Arm 305 may be an L-shaped or otherwise retractable or extendable arm, and may be coupled with a torque-controlled motor, which may be incorporated with the arm or connected with the arm. The torque-controlled motor may drive the arm between the first and second positions, and may also be configured to maintain contact between the cleaning head and the seal to be cleaned.

Arm 305 may also include one or more fluid delivery tubes 307*a* or fluid removal tubes 307*b* that may extend along the arm. The tubes may be coupled with one or more reservoirs or other materials that may be used for the cleaning operation, and may couple or fluidly connect with cleaning head 310. For example, fluid delivery tube 307*a* may provide one or more cleaning solutions into the cleaning head, while fluid removal tube 307*b* may remove the cleaning solution subsequent interaction with the seal to be cleaned. Cleaning head 310 may allow the cleaning solution to be delivered to and removed from the seal without contacting other chamber components, dripping, or otherwise interacting with system head 22. The seal contact and cleaning operations will be described in more detail below.

Cleaning head 310 may be multiple components coupled together, or may be a single piece machined design that incorporates one or more aspects in the design. Cleaning head 310 may include a bracket portion 312, by which the cleaning head 310 may be coupled with arm 305, such as with a distal portion of arm 305. The bracket portion 312 may be coupled with the head rigidly with any number of components including fastening components, adhesive, or the bracket portion may include a form configured to accommodate snap-fitting the cleaning head on the arm. Any number of aspects of the arm or the cleaning head bracket portion may be adjusted to provide a coupling between the components.

A front portion 314 of cleaning head 310 may extend from bracket portion 312 in a first direction, and a back portion 316 of cleaning head 310 may extend from bracket portion 312 in a second direction opposite the front portion. Front portion 314 may be formed to interface with a seal of the electroplating system head. For example, the contact seal may be an annular component, and thus may be characterized by a curved profile along the inner and outer surfaces. Accordingly, front portion 314 may be at least partially characterized by an arcuate profile configured to accommodate the curvature of the seal. This may allow an improved contact to be afforded between the components to reduce the opportunity for fluid leaks or dripping.

Cleaning head 310 may define a trench 318 along the front portion 314. Trench 318 may be defined by an upper sidewall 320 and a lower sidewall 322, and may face the seal to be cleaned. One or both of the upper sidewall 320 and the lower sidewall 322 may exhibit the arcuate profile in embodiments. For example, in some embodiments lower sidewall 322 may exhibit an arcuate profile along the front portion 314 of the cleaning head 310. The lower sidewall may be characterized by a curvature equivalent to the curvature of the seal to limit any fluid leakage out of the trench through a space formed between the components.

Cleaning head 310 may be made of any number of materials or combinations of materials. In some embodiments, the cleaning head 310 may include a polymeric material that may be resistant to damage from cleaning solutions that may be used. For example, as will be explained in relation to the operational method below, the cleaning solutions may include an acidic solution in some embodiments. Accordingly, cleaning head 310 may include materials that are resistant to acidic solutions that may flow through the cleaning head. Additionally, water, either in the acidic solutions or with a separate delivery, may be flowed through the cleaning head 310. In some embodiments cleaning head 310 may include a hydrophobic material that may resist wetting by the cleaning fluids, and may facilitate movement and removal of the cleaning fluids through the cleaning head 310. By utilizing hydrophobic materials, the cleaning fluid may better fill the volume of the trench because it may be repelled from the cleaning head forming a high contact angle of the cleaning solution on the surfaces of the cleaning head, such as greater than 90°. This may ensure that the entire surface of the seal is contacted by the cleaning solution. For example, cleaning head 310 may be or include a similar or identical material to the seal to be cleaned, and may be any of the materials previously described. Cleaning head 310 may also be or include a fluoropolymer, including polyvinyl fluorides, fluoroethylene compounds including polytetrafluoroethylene, fluoropropylene compounds, and other compounds that may resist any materials used in electroplating or in the cleaning operations to be discussed.

Figure 4:
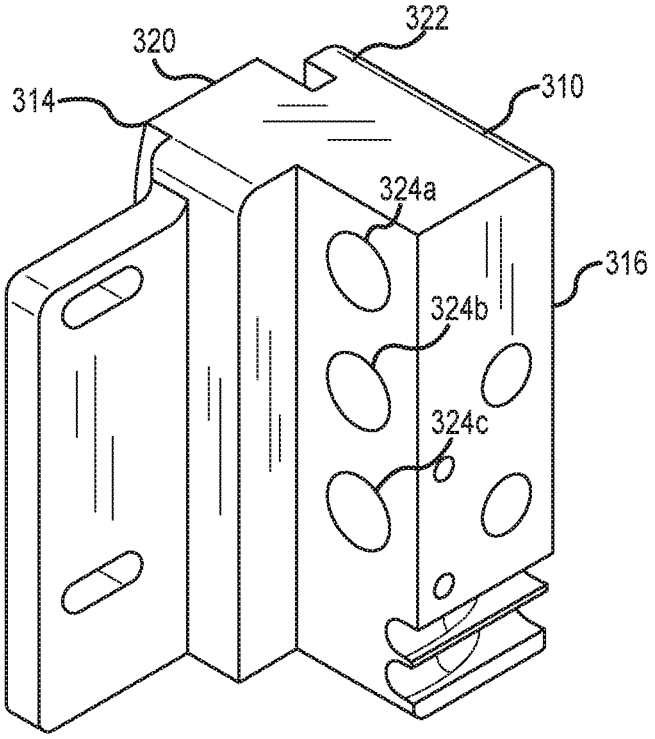
FIG. 4 shows a schematic perspective view of a cleaning head according to some embodiments of the present technology.

FIG. 4 shows a schematic perspective view of cleaning head 310 according to some embodiments of the present technology. FIG. 4 may further illustrate back portion 316 of cleaning head 310, and may illustrate fluid delivery ports 324. As previously explained, fluid tubes 307 may extend along arm 305 and may be fluidly connected with cleaning head 310. The tubes may be fluidly coupled with the cleaning head 310 via the fluid delivery ports 324, defined or positioned in back portion 316 of the cleaning head. Three fluid delivery ports 324 are illustrated, although depending on the size and configuration of the cleaning assembly, any number of fluid delivery ports 324 may be included with the system. The fluid delivery ports may access trench 318, such as a backside of trench 318 as will be shown below, and may be used to deliver cleaning solutions to the trench, or may be used to retrieve cleaning solutions from the trench. For example, in one embodiment included for illustration of possible configurations encompassed by the technology, fluid delivery port 324*a* may be fluidly coupled with fluid delivery tube 307*a*, and fluid delivery ports 324*b*, 324*c* may be fluidly coupled with two fluid removal tubes 307*b*. Any other configuration may also be accommodated by the cleaning assembly as would be understood by the skilled artisan.

Figure 5:
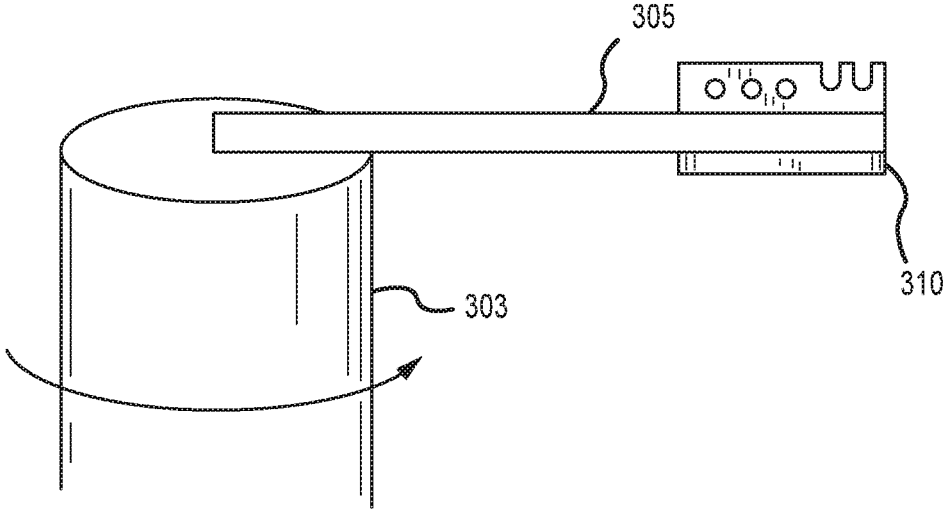
FIG. 5 shows a schematic exemplary apparatus for positioning a cleaning head according to some embodiments of the present technology.

FIG. 5 shows a schematic exemplary apparatus for positioning a cleaning head according to some embodiments of the present technology. The apparatus illustrated may include a base 303 within which the torque-controlled motor may be connected. Coupled with base 303 may be arm 305, with which cleaning head 310 may be coupled at a distal location. As previously described, base 303 may be operable to pivot or swing arm 305 allowing cleaning head 310 to be positioned relative to a seal or other device to be cleaned. Cleaning head 310 may be maintained in a retracted or withdrawn position during operation of base 303, which may facilitate positioning cleaning head 310, while limiting the opportunity of cleaning head 310 to contact the seal or other components. By maintaining cleaning head 310 in a downward facing position recessed upwards, cleaning head 310 may be passed over a seal to be cleaned before being positioned in contact with the seal.

Figure 6:
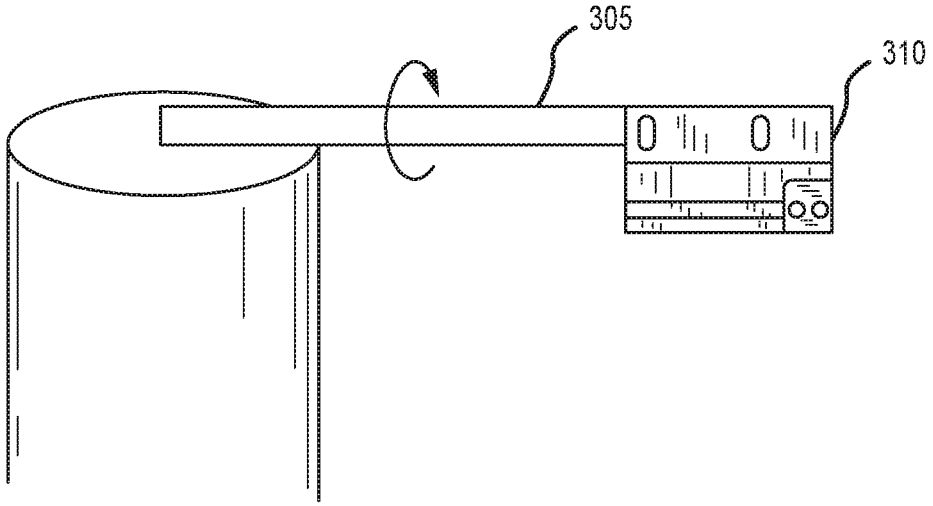
FIG. 6 shows a schematic exemplary apparatus for positioning a cleaning head according to some embodiments of the present technology.

FIG. 6 shows a schematic exemplary apparatus for positioning a cleaning head according to some embodiments of the present technology. Once cleaning head 310 has been swung into an interior region of the seal, arm 305 may rotate to position cleaning head 310 in an operational position in which it may contact a seal or other component to be cleaned. Although in some embodiments, arm 305 may rotate in either direction to operationally position cleaning head 310, in some embodiments, arm 305 may swing clockwise to provide an amount of compression of the cleaning head 310 against the seal. FIGS. 5-6 illustrate one possible system for delivering cleaning head 310 to a seal or component to be cleaned, but it is to be understood that any system may be used to pivot, rotate, or otherwise position cleaning head 310 against a seal to be cleaned.

Figure 7:
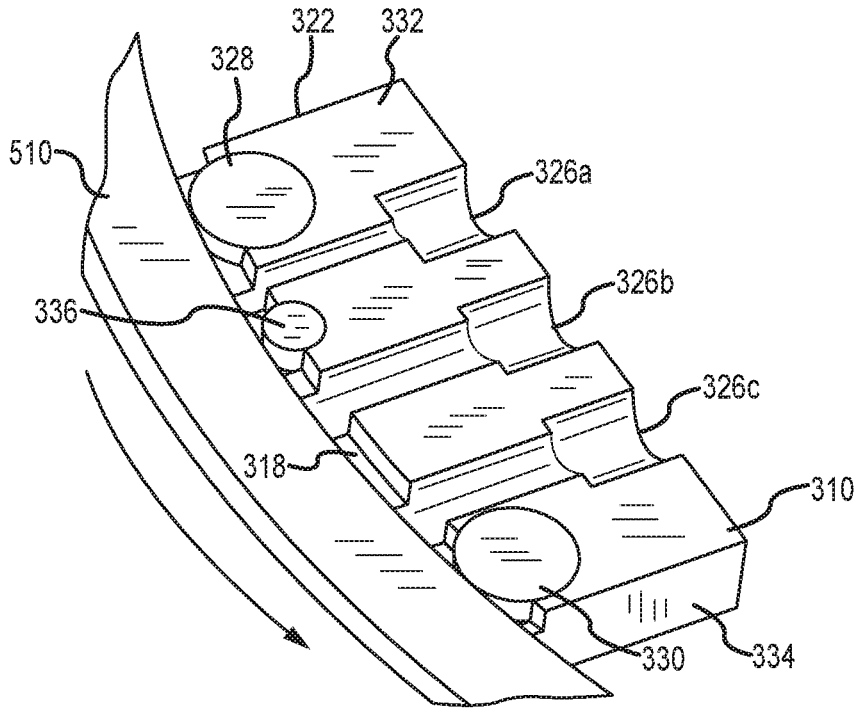
FIG. 7 shows a partial cross-sectional view of a cleaning head in operation according to some embodiments of the present technology.

Previously described FIG. 4 additionally illustrates that upper sidewall 320 may extend laterally beyond an outer edge of lower sidewall 322 in some embodiments. For example, when engaged with a seal, as will be shown below, upper sidewall 320 may extend beyond an inner wall of the seal, such that the seal may at least partially reside within trench 318 during cleaning. FIG. 7 illustrates a partial cross-sectional view of cleaning head 310 in operation according to some embodiments of the present technology. The cross section may be through trench 318, such as just below upper sidewall 320, for example. As illustrated, and shown in the cross-section, the cleaning head 310 may define a plurality of fluid channels 326 through the cleaning head. Each fluid channel 326 may fluidly access a backside of trench 318. Fluid channels 326 may extend to the backside of cleaning head 310 and be accessed from fluid delivery ports 324. Accordingly, in some embodiments the number of fluid delivery ports may be equivalent to the number of fluid delivery channels. The fluid delivery channels may include a larger diameter portion and a smaller diameter portion as illustrated, with the smaller diameter portion being positioned between the trench 318 and the larger diameter portions. The adjustment in channel diameter may further facilitate fluid movement through the cleaning head.

The cleaning head may include one or more contact pins that may interact with the seal to be cleaned. As illustrated, cleaning head 310 may contact seal 510 on contact pin 328 and contact pin 330. In operation, the system head rotor may rotate seal 510 across cleaning head 310. The direction of rotation as illustrated may begin at a leading edge 332 of cleaning head 310 and extend laterally or radially along the cleaning head to trailing edge 334. Contact pin 328 may at least partially extend through trench 318, and may be positioned vertically through front portion 314 of cleaning head 310. Contact pin 328 may be positioned proximate leading edge 332 of cleaning head 310. The contact pin 328 may be configured to be in direct contact with seal 510 during a cleaning operation. Additionally, contact pin 330 may be identical to contact pin 328, and may be positioned proximate trailing edge 334 of cleaning head 310 in the direction of rotation of seal 510 across the cleaning head. By having the contact pins extend only partially within trench 318 in some embodiments, the seal may at least partially recess within the trench both above and below the seal. Accordingly, a cleaning volume may be defined within trench 318 between the first contact pin 328, the seal 510, and the second contact pin 330. This volume may be configured to maintain cleaning fluid delivered through the fluid channels of the cleaning head to limit or prevent any leakage from the cleaning head.

Cleaning head 310 may also include a clearance pin 336 positioned between the first contact pin 328 and the second contact pin 330. Clearance pin 336 may at least partially extend through the trench 318 similar to the contact pins. Unlike the contact pins, clearance pin 336 may not contact seal 510 in some embodiments. Clearance pin 336 may instead define a gap between the clearance pin and the seal when the contact pins are in direct contact with the seal 510. Consequently, clearance pin 336 may facilitate contact between a delivered cleaning fluid and the seal to ensure complete wetting of the seal during the seal rotation. As previously described, the components of cleaning head 310 may be hydrophobic, and thus depending on the gap distance between the trench and the seal, cleaning fluid may flow from a fluid delivery channel to a fluid removal channel without contacting the seal, or intermittently contacting the seal.

By including a clearance pin 336, a reduced gap may be maintained that may be utilized to ensure contact entirely along the surface of the seal as it rotates across the cleaning head. In some embodiments, the gap may be less than or about 1 cm, and may be less than or about 9 mm, less than or about 8 mm, less than or about 7 mm, less than or about 6 mm, less than or about 5 mm, less than or about 4 mm, less than or about 3 mm, less than or about 2 mm, less than or about 1 mm, less than or about 0.5 mm, less than or about 0.2 mm, or less, depending on the size of the system, and surfaces to be cleaned. Contact pins 328, 330 and clearance pin 336 may be similar or different materials from the seal or cleaning head, and may be or include any of the materials previously described. The pins may be common plastics including polyethylene, or any other long chain polymeric material, which may provide low friction or other beneficial properties, such as impact strength for when the cleaning head impacts the seal. Additionally, the pins may include any other polymer that may resist abrasion as the contact pins may be in direct contact with the seal, although the material may be compatible with the seal material to limit damage to the seal. Each of the pins may also be accessible from below the cleaning head allowing replacement if necessary.

The clearance pin 336 may be positioned within the cleaning head between inlet channels and outlet channels for the cleaning fluid. For example, as illustrated, first fluid channel 326*a* may extend inward of contact pin 328 and into trench 318 at a first position. Second fluid channel 326*b*, as well as third fluid channel 326*c*, may fluidly access a second position, and third position respectively, along the trench radially or laterally offset from the first position in a direction of rotation of the seal. Clearance pin 336 may be positioned between the first fluid channel and the second fluid channel, and may be positioned at least partially within the trench between the first position and the second position.

A cleaning solution may be flowed or pumped into first fluid channel 326*a*, such as by delivering the cleaning solution through fluid delivery tube 307*a* to the first delivery port in the cleaning head 310. Second fluid channel 326*b*, as well as third fluid channel 326*c*, may be used to retrieve the cleaning solution after it has contacted and interacted with seal 510 about clearance pin 336. The second fluid channel and third fluid channel may be coupled through the fluid removal tubes with a vacuum system, such as an aspirator, which may allow a suction action to be performed to draw the cleaning fluid from the trench 318 and from the cleaning head 310. The seal may be rotated during the flow of cleaning solution to enable the entire seal to be cleaned on one or more surfaces. As mentioned previously, a torque-controlled motor may be coupled with the arm on which the cleaning head is coupled, and may ensure the cleaning head maintains contact with the seal all along the seal as it is rotated.

Figure 8:
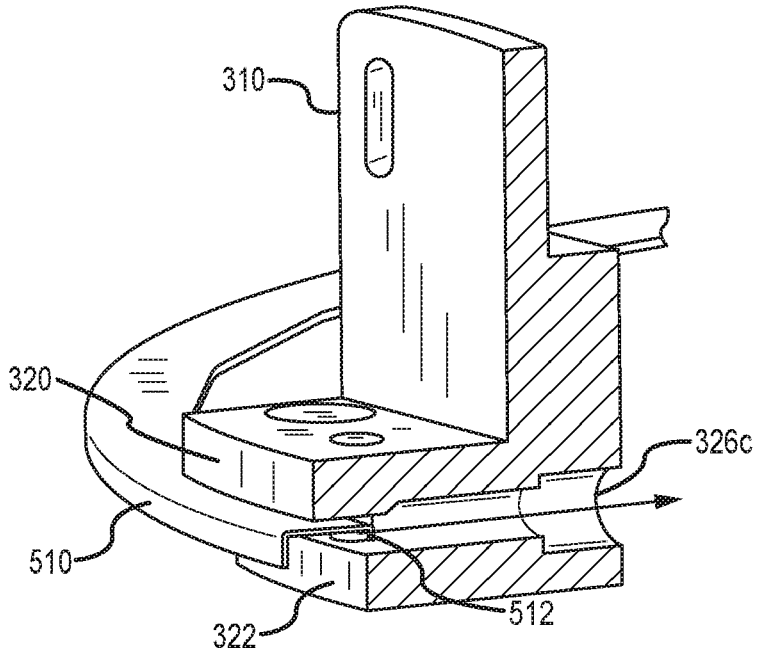
FIG. 8 shows a partial cross-sectional view of a cleaning head in operation according to some embodiments of the present technology.

FIG. 8 shows another partial cross-sectional view of cleaning head 310 in operation according to some embodiments of the present technology. The partial cross-section may be vertically through third fluid channel 326*c*. FIG. 8 shows additional aspects of the seal 510, which may include an inner annular sidewall 512. This sidewall may be the location where electroplating residues occur, and in some embodiments this sidewall may be the only location to contact the electrolyte. When the arm on which the cleaning head is rotated, such as rotated clockwise, the cleaning head may swing down from a raised or retracted position, and may directly contact seal 510 along the inner annular sidewall 512, such as with the contact pins previously described. The inner annular sidewall 512 may extend within the trench 518 and may recess beneath upper sidewall 320 of trench 318 of the cleaning head 310. The seal may also at least partially recess across lower sidewall 322 in some embodiments, and lower sidewall 322 may be characterized by an arcuate profile to accommodate the shape of the seal to limit cleaning solution leakage between the components. By utilizing this cleaning assembly, an in situ clean may be performed on a seal to reduce or eliminate residues on the seal, which may be conductive and could affect plating operations.

Figure 9:
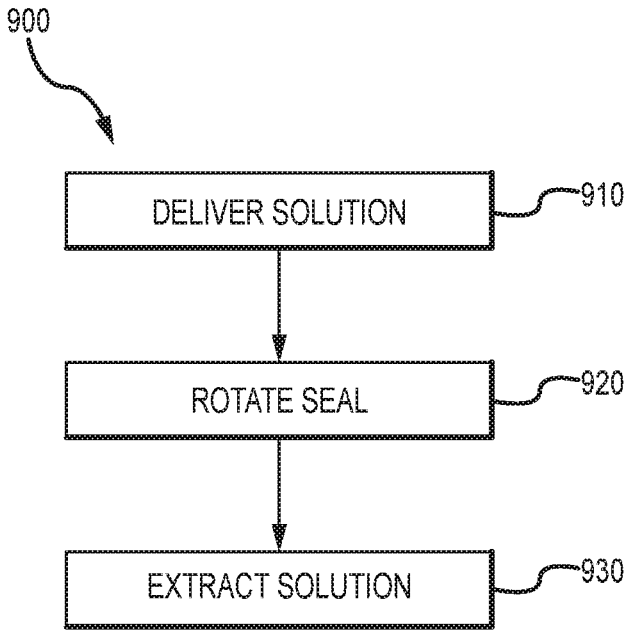
FIG. 9 shows operations of an exemplary method of cleaning a contact seal according to some embodiments of the present technology.

The systems and components previously described may be used in a number of methods for in situ component cleaning. FIG. 9 shows operations of an exemplary method 900 of cleaning a contact seal of an electroplating system according to some embodiments of the present technology, and which may use any of the components previously described, such as cleaning head 310. Method 900 may include operations prior to the actual seal cleaning. For example, prior to the cleaning, a system head may be positioned, such as inverted, to expose a contact seal or other component to be cleaned. An arm of a cleaning assembly may position within an interior of the head, and may rotate a cleaning head into contact with the contact seal or other component. A cleaning solution may be delivered into contact with the seal through the cleaning head at operation 910. The cleaning head may be positioned to physically contact the electroplating system contact seal, and the cleaning solution may be delivered through a first fluid channel of the cleaning head. The seal may be rotated across the cleaning head at operation 920, which may allow an entire surface to be contacted by the cleaning solution. The cleaning solution may be extracted from the cleaning head during the rotation and delivery of the cleaning solution through a second fluid channel radially offset from the first fluid channel in a direction of rotation of the electroplating system at operation 930. Although illustrated in a particular succession, operation 910 and operation 920 may occur in any order, including concurrently. For example, method 900 may begin by rotating the seal, which may operate to draw the cleaning solution as it enters the cleaning head from a delivery channel to a retrieval channel. By initiating the operation with rotation of the seal, a balance may be developed between fluid flow and evacuation rates utilizing the seal to facilitate delivery of the fluid from delivery channels to return flow channels. Additionally, the seal rotation of operation 920 may be performed simultaneously with delivery of the solution.

In some embodiments, the cleaning solution may be or include an acidic solution. The residues may include metal ions or materials on the surface of the seal, which may be removed by an acid wash. The acidic solution may be selected based on the metal being electroplated, and may include nitric acid, acetic acid, sulphuric acid, or any other organic or inorganic acid as well as acid mixture that may facilitate removal of copper materials, nickel materials, tin-silver solders, or other materials that may be electroplated and may cause residues to form on the seal, including metal-organic materials and complexed metals, such as, for example, silver in a tin silver bath.

As previously explained, the cleaning head may be formed of a hydrophobic material, which may limit or prevent wetting of the cleaning solution onto the cleaning head materials. The delivery of the cleaning solution, removal of the cleaning solution, and rotation of the seal may also be performed in a manner to limit contact of the solution with surfaces of the cleaning head, as well as to limit dripping or leakage of the solution from the cleaning head into contact with any other component of the system head. For example, an acid solution may cause damage to contacts if it is allowed to interact with the contacts, accordingly, by carefully controlling the delivery and removal of the solution, acidic solutions may be used in the present technology, unlike other in situ systems that may be limited to water. Utilizing the present technology, the cleaning solution may be substantially maintained within a volume defined in part by an inner surface of the contact seal, a trench formed within a front portion of the cleaning head, and one or more contact pins at least partially extending through the trench proximate leading and trailing edges of the cleaning head in a direction of rotation of the contact seal across the cleaning head.

In some embodiments a water rinse may be performed with water, such as deionized water, subsequent delivery and removal of the cleaning solution. The water may be delivered in substantially the same fashion as the cleaning solution. In some embodiments the water may be delivered at a greater volumetric flow rate than the cleaning solution. By delivering additional water relative to the removal rate, the water may be flowed further within the volume, such as to interact with contact pin 328, or contact pin 330, which may allow any residual cleaning solution to be effectively flushed from the cleaning head. Additionally, an amount of water may be leaked or ejected from the cleaning head, which may allow a rinse of the underlying contact on the system head. The present technology provides the ability to clean contact seals in situ, which limits down time of electroplating equipment, while also limiting conductive residue formation on exposed tool surfaces, which may affect plating uniformity on a substrate. Accordingly, improved throughput and quality may be afforded by systems and methods according to the present technology.

In the preceding description, for the purposes of explanation, numerous details have been set forth in order to provide an understanding of various embodiments of the present technology. It will be apparent to one skilled in the art, however, that certain embodiments may be practiced without some of these details, or with additional details. For example, other substrates that may benefit from the wetting techniques described may also be used with the present technology.

Having disclosed several embodiments, it will be recognized by those of skill in the art that various modifications, alternative constructions, and equivalents may be used without departing from the spirit of the embodiments. Additionally, a number of well-known processes and elements have not been described in order to avoid unnecessarily obscuring the present technology. Accordingly, the above description should not be taken as limiting the scope of the technology.

Where a range of values is provided, it is understood that each intervening value, to the smallest fraction of the unit of the lower limit, unless the context clearly dictates otherwise, between the upper and lower limits of that range is also specifically disclosed. Any narrower range between any stated values or unstated intervening values in a stated range and any other stated or intervening value in that stated range is encompassed. The upper and lower limits of those smaller ranges may independently be included or excluded in the range, and each range where either, neither, or both limits are included in the smaller ranges is also encompassed within the technology, subject to any specifically excluded limit in the stated range. Where the stated range includes one or both of the limits, ranges excluding either or both of those included limits are also included. Where multiple values are provided in a list, any range encompassing or based on any of those values is similarly specifically disclosed.

As used herein and in the appended claims, the singular forms "a", "an", and "the" include plural references unless the context clearly dictates otherwise. Thus, for example, reference to "a material" includes a plurality of such materials, and reference to "the channel" includes reference to one or more channels and equivalents thereof known to those skilled in the art, and so forth.

Also, the words "comprise(s)", "comprising", "contain(s)", "containing", "include(s)", and "including", when used in this specification and in the following claims, are intended to specify the presence of stated features, integers, components, or operations, but they do not preclude the presence or addition of one or more other features, integers, components, operations, acts, or groups.

What is claimed is:

1. An electroplating apparatus seal cleaning assembly comprising:

an arm pivotable between a first position and a second position, wherein the arm is rotatable about a central axis of the arm; and a cleaning head including a bracket portion coupled with a distal portion of the arm, the cleaning head comprising a front portion formed to interface with a seal of an electroplating apparatus, wherein the cleaning head defines a trench along the front portion, wherein the cleaning head defines a plurality of fluid channels through the cleaning head, each fluid channel of the plurality of fluid channels fluidly accessing a backside of the trench, wherein the cleaning head further comprises a contact pin at least partially extending through the trench and configured to be in direct contact with the seal.

2. The electroplating apparatus seal cleaning assembly of claim 1, wherein the front portion of the cleaning head is at least partially characterized by an arcuate profile configured to accommodate an annular seal.

3. The electroplating apparatus seal cleaning assembly of claim 1, wherein the cleaning head further comprises a clearance pin at least partially extending through the trench and configured to define a gap between the clearance pin and the seal when the contact pin is in direct contact with the seal.

4. The electroplating apparatus seal cleaning assembly of claim 3, wherein the plurality of fluid channels comprises:

a first channel fluidly accessing a first position along the trench; and a second channel fluidly accessing a second position along the trench radially offset from the first position in a direction of rotation of the seal.

5. The electroplating apparatus seal cleaning assembly of claim 4, wherein the clearance pin is positioned between the first position and the second position.

6. The electroplating apparatus seal cleaning assembly of claim 1, wherein the cleaning head comprises a hydrophobic material.

7. An electroplating system comprising:

a system head having a rotor, the system head configured to hold a substrate for processing;

a seal positioned on the rotor;

a head lifter coupled with the system head and configured to position the system head; and a seal cleaning assembly comprising:

an arm pivotable between a first position and a second position where a distal portion of the arm is vertically aligned with an interior region of the system head, wherein the arm is rotatable about a central axis of the arm, and a cleaning head including a bracket portion coupled with a distal portion of the arm, the cleaning head characterized by a front portion formed to interface with an interior surface of the seal, wherein the cleaning head defines a trench along the front portion, wherein the cleaning head defines a plurality of fluid channels through the cleaning head, each fluid channel of the plurality of fluid channels fluidly accessing a backside of the trench, wherein the cleaning head further comprises a contact pin at least partially extending through the trench and configured to be in direct contact with the seal during a cleaning operation.

8. The electroplating system of claim 7, wherein, when the arm is located in the second position, the distal portion of the arm is configured to rotate the cleaning head from a retracted position into direct contact with the seal.

9. The electroplating system of claim 8, further comprising a torque-controlled motor configured to drive the arm and maintain contact between the cleaning head and the seal while the rotor rotates the seal across the cleaning head.

10. The electroplating system of claim 7, where the seal is characterized by an annular form, and wherein the front portion of the cleaning head is at least partially characterized by an arcuate profile configured to accommodate an inner annular sidewall of the seal.

11. The electroplating system of claim 7, wherein the cleaning head further comprises a clearance pin at least partially extending through the trench and configured to define a gap between the clearance pin and the seal when the contact pin is in direct contact with the seal.

12. The electroplating system of claim 11, wherein the plurality of fluid channels comprises:

a first channel fluidly accessing a first position along the trench; and a second channel fluidly accessing a second position along the trench radially offset from the first position in a direction of rotation of the seal.

13. The electroplating system of claim 12, wherein the clearance pin is positioned between the first position and the second position.

14. The electroplating system of claim 13, further comprising a fluid delivery tube extending along the arm and configured to provide a fluid to the first channel.

15. The electroplating system of claim 14, further comprising a fluid removal tube extending along the arm and configured to remove the fluid from the second channel.

16. The electroplating system of claim 15, wherein a vacuum is maintained through the fluid removal tube during operation.

* * * * *